United States Patent [19]

Dondero

[11] 4,086,859

[45] May 2, 1978

[54] BOAT TABLE

[76] Inventor: George V. Dondero, P.O. Box 1581, Ketchum, Id. 83340

[21] Appl. No.: 703,088

[22] Filed: Jul. 6, 1976

[51] Int. Cl.[2] ..... A47B 11/00

[52] U.S. Cl. ..... 108/142; 108/44

[58] Field of Search ..... 297/174; 108/142, 139, 108/44, 48, 150, 152, 159, 137; 248/240.2, 240.4, 224

[56] References Cited

U.S. PATENT DOCUMENTS

| | | | |
|---|---|---|---|
| 438,280 | 10/1890 | Wright | 108/152 |
| 830,187 | 9/1906 | Spencer | 108/33 |
| 1,235,359 | 7/1917 | Merz | 108/141 |
| 1,271,170 | 7/1918 | Jellinek et al. | 248/240.2 |
| 1,696,518 | 12/1928 | Bowman et al. | 108/139 X |
| 1,859,719 | 5/1932 | Schrage | 108/139 X |
| 2,245,951 | 6/1941 | Agee | 248/240.2 |
| 2,520,450 | 8/1950 | Austin | 108/150 X |
| 2,939,364 | 6/1960 | Doswell et al. | 248/224 X |
| 3,157,379 | 11/1964 | Platakis | 248/278 |
| 3,391,960 | 7/1968 | Megargle et al. | 296/24 R |

*Primary Examiner*—Roy D. Frazier
*Assistant Examiner*—Peter A. Aschenbrenner
*Attorney, Agent, or Firm*—Flehr, Hohbach, Test, Albritton & Herbert

[57] ABSTRACT

A swivel mounted boat table including an upstanding offset support. The table is mounted on the upstanding support, which is vertically and rotatably movable within clamp means held by a side bracket so that the offset portion of the support provides a lateral pivot extension. The table can be moved to desired position and the clamp means engaged to hold the table in desired pivot position. If desired, the table can also be rotatably positioned on the upstanding support. The swivel mounted table is adapted to be used at differing locations in the boat (e.g., cockpit, cabin) at various desired pivot positions and heights, and can be alternatively locked in position or swung out of the way to allow passage. The table is also easily assembled or disassembled for storage.

12 Claims, 15 Drawing Figures

BOAT TABLE

BACKGROUND OF THE INVENTION AND OBJECTS

This invention relates generally to improvements in tables, and more particularly to an improved swivel mounted boat table that can be selectively held at desired height and pivot position, either in place or swung out of the way to permit passage, and which is easily disassembled for storage.

In the design of pleasure craft (sail or powered), the need to conserve space while providing ample room for essential equipment and free passage of personnel, is predominant. For this reason, seating space is usually minimal and tables in the conventional sense are either nonexistent or designed for fold-away storage within a below-decks compartment. On the other hand, there is constant need for a table in the cockpit or other operating area of a boat, for use as a chart table, for food preparation or service, and so on.

The present invention is directed to a solution to the above and additional problems as will appear.

It is a general object of the inventon, therefore, to improve upon boat tables of the type described, particularly with respect to means providing a swivel based mounting for the table so that the table can be alternately positioned at a point of use or swung out of the way to enable free passage.

It is another object of the invention to provide a boat table of such character which has a laterally offset support held by clamp means insertable in a support bracket, whereby the boat table can be clamped and retained either in a position of use or in a position which is out of the way.

It is another object of the invention to provide a boat table of such character which is readily assembled at any desired position in a cockpit or other portion of a boat, and which is just as easily disassembled for relatively quick flat storage.

Additional objects and advantages of the invention will appear from the detailed description thereof and from the drawings.

SUMMARY OF THE INVENTION

Broadly stated, the present invention is directed to the concept of a boat table which is carried by an upstanding swivel support and cooperating clamps means that can be positioned and held within any one of several side brackets provided in the cockpit, cabin or other area of a boat. The swivel support comprises an upstanding generally cylindrical (tubular) member which is provided with an offset portion to provide a lateral pivot extension for the table. In one form of the invention, the side bracket has an upwardly opening recess within which a lug carried by the clamp means can be slidingly received. The upstanding support for the table is rotatably and also slidably received within the clamp means so that vertical and pivotal adjustments of the table position with respect to the clamp means are easily obtained. A base support (e.g., socket) is also provided either in the floor of the cockpit or as a further side bracket. The table can also be rotatably mounted on an upper end of the upstanding support and locking means provided to position the table in desired rotary position.

In use, the table and its swivel support are vertically adjusted with respect to clamp means, so that the lower end of the support can be positioned in the base support or socket. The clamp means is then inserted in a selected side bracket and the table pivoted within the clamp means to the desired point of use, for example, adjacent a built in seat. The clamp means can then be operated to lock the table in its desired position of use. As may be necessary, the clamp means can be temporarily loosened and retightened, for example, to enable the table to be swung out of the way to permit free passage through the cockpit or to facilitate operating or navigating the boat. The described arrangement of the table thus conserves space for movement between the cabin and cockpit of the boat, yet enables placement and locking of the table in position for drinks, food, charts, or other conventional use.

The foregoing as well as other advantages of the invention will appear from the following description and from the drawing.

DESCRIPTION OF PREFERRED EMBODIMENTS

Figures 1, 6:
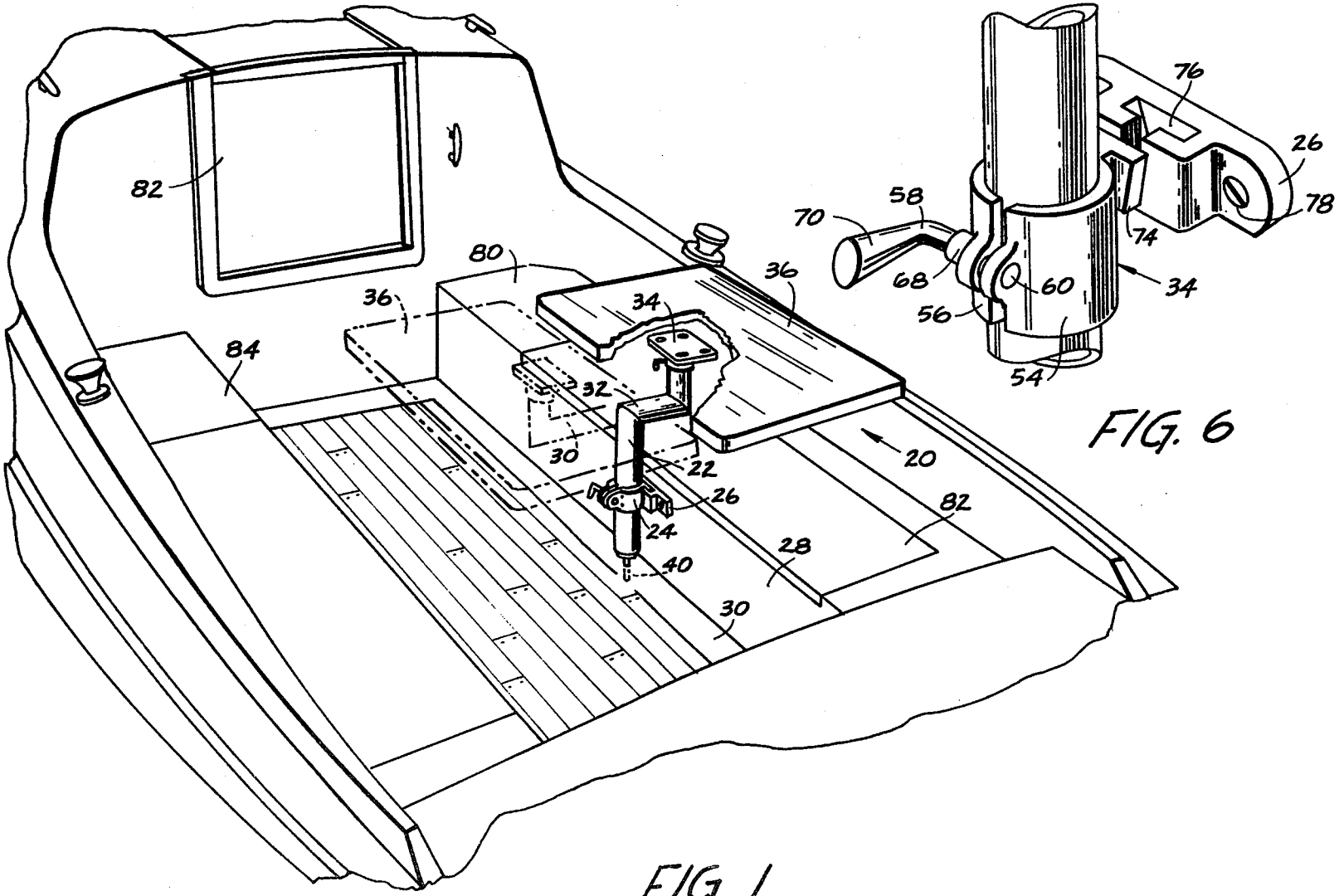
FIG. 1 is a view in perspective, with parts broken away or shown in phantom, illustrating an improved boat table in accordance with the invention.
FIG. 6 is a like view illustrating a particular feature of the embodiment of FIG. 1.
Figure 2:
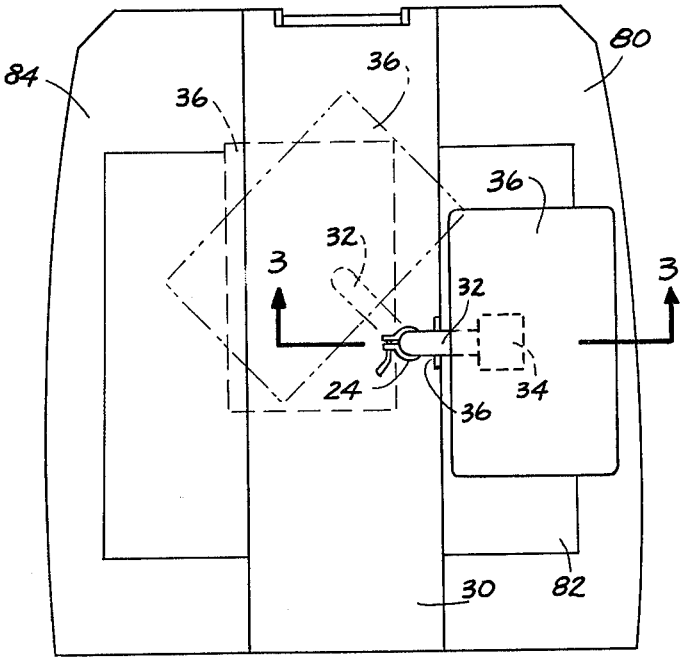
FIG. 2 is a top plan view, in reduced scale, showing the boat table of FIG. 1.
Figure 5:
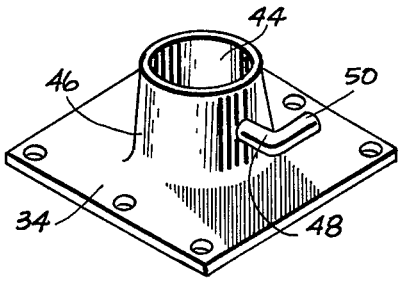
FIG. 5 is an enlarged view in perspective of a device useful in the embodiment of FIG. 1.

Referring to FIGS. 1 and 2, 20 generally represents an improved boat table according to the present invention. As illustrated, the boat table includes an upstanding support 22 which is carried by clamp means 24 insertable in a side bracket 26. The side bracket 26 is appropriately secured to a vertical bulkhead 28 whereas the lower end of the support 22 is received and supported within a base support or footing structure 30. The upstanding support 22 includes an offset portion 32 which provides a lateral pivot extension. At its upper end, the upstanding support is provided with mounting means 34 for a table, shown in the drawings as a substantially planar slab 36. Of course, the table structure 36 can have various configurations or be provided with attachments (not shown) to accommodate its use to navigation or operation of the boat, to food preparation or service, and so forth.

Referring to FIGS. 3–6, the upstanding support 22 is illustrated to be of generally tubular construction, for example, anodized aluminum or like metallic material, with integral or welded joints between the offset portion 32 and the upstanding portions 22a and 22b. It will be appreciated that the segments 22a and 22b of the upstanding support can be of variable lengths, as may be necessary to adapt the boat table 20 to differing boat structures. At its lower end, the upstanding support is provided with means 38 for mounting a pin or like extension 40 which may be received in an aperture 42 provided in the footing or deck 30. At its upper end, the upstanding support 22 can be rotatably received within a generally cylindrical recess 44 provided within a cylindrical extension 46 of the table mounting means 34. A frictionally engageable member 48 is threaded through the extension 46, and is provided with a crank extension 50 to facilitate locking of the table at a fixed rotary position with respect to the upstanding support. The table 36 is secured to the table mounting member 34 by any suitable fastening device, such as the wood screws 52.

Figure 3:
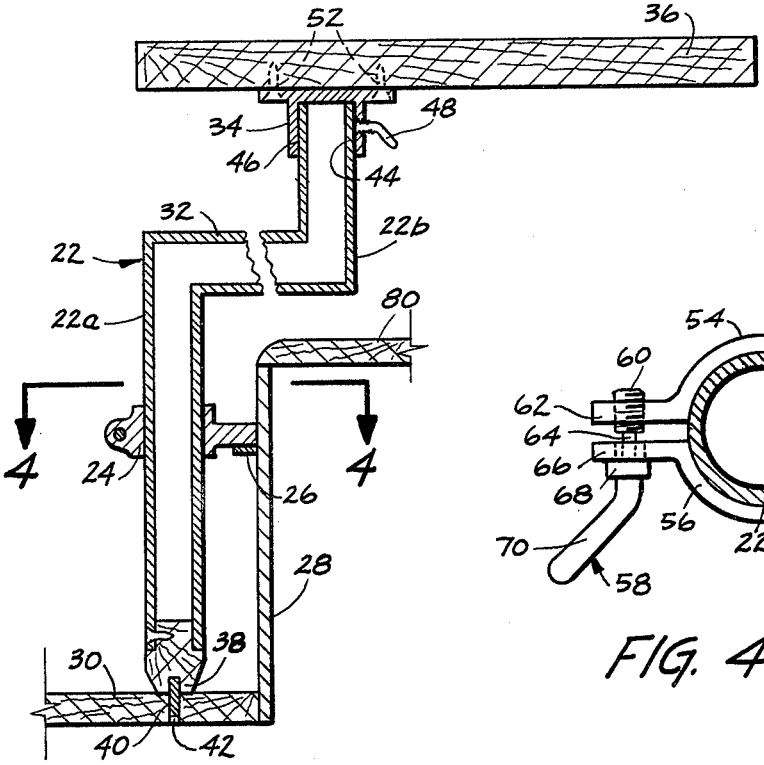
FIG. 3 is an enlarged view in vertical section, along the line 3—3 of FIG. 2.
Figure 4:
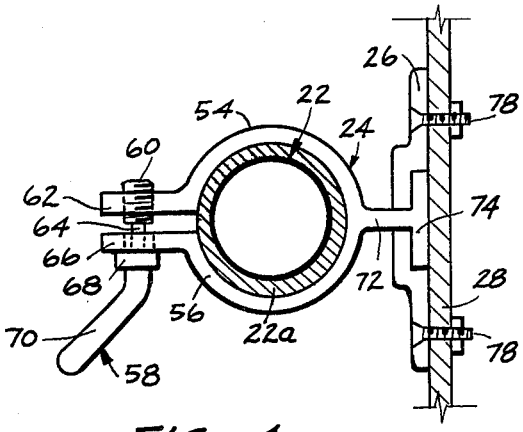
FIG. 4 is an enlarged detail view in horizontal section, along the line 4—4 of FIG. 3.

As particularly shown in FIGS. 3, 4 and 6, the upstanding support 22 is vertically and rotatably movable within the clamp means 24, and is held in desired upright position by the side bracket 26. More specifically, the clamp means 24 includes opposed semicylindrical members 54 and 56 which can be brought together in a clamping operation by manually operable means 58. In the illustrated apparatus, the manually operable means 58 includes a threaded end 60 within an extension 62 of the clamp segment 54, a reduced portion 64 passing through an aperture in an extension 66 of the clamp segment 56, an enlarged bearing surface 68, and a crank extension 70. It will be appreciated that the crank 70 can be employed to urge the segments 54 and 56 toward one anotherin a locking or clamping operation, or, alternatively, away from one another in a loosening or unclamping operation. At a medial position, the clamping means 24 is provided with an extension 72 terminating in a shaped lug 74. In the illustrated apparatus, the lug 74 tapers downwardly to cooperate with a similarly shaped recess 76 provided in th side bracket 26. The side bracket 26 is firmly secured to the bulkhead 28 by means of bolts 78 or other appropriate fastening members.

Assembly and installation of the boat table of FIGS. 1–6 is readily accomplished. In one procedure, the table mounting member 34 is first secured in desired location on the under side of the table 36. Such location may be centralized or off-center, as illustrated. The side bracket 26 is attached at desired vertical elevation on the bulkhead 28. The clamp means 24 is then positioned within the side bracket by inserting the cooperating shaped lug 74 in the shaped recess 76. Vertical extension 22a of the upstanding support 22 is then dropped through the clamp means in such fashion that the pin 40 can be inserted in the aperture 42 in the deck or footing 30. The table 36 and mounting member 34 are now placed on the segment 22b of the upstanding support so that the upper end of the segment 22b is received within the recess 44 of the extension 46. The table is tightened onto the upstanding support by means of the locking lever 48 and the table pivoted on the lateral extension 32 of the upstanding support 22 to desired position. The crank 58 is now manipulated to move the segments 54, 56 of the clamping means 24 toward one another in a clamping or locking oeration, thus firmly positioning the boat table in desired position.

In use, the boat table of the present invention provides many advantages. Thus, assuming that the table is in the full line position of FIGS. 1–3, the table is conveniently disposed for one sitting fore or aft of the table on the seat 80, and is out of the way as respects passage between the stern of the boat and the compartment 82. However, if it is desired to get into the storage compartment below the hatch cover 82, or if the table is to be used by one sitting on the opposite seat 84, the table is easily swung to the dotted line position (longitudinal) shown in FIGS. 1 and 2 by the simple expedient of loosening the clamping means 24, pivoting the table to the new position and retightening the clamping means. Other positions of the table (e.g., angular dotted position of FIG. 2) are likewise easily obtained. If the table is to be moved for storage, it can be readily disassembled by a generally reverse procedure to the assembly procedure described above. When not in use, components of the boat table can be easily and quickly stowed away flat, thus requiring a minimum of space in the storage compartment.

Figure 7:
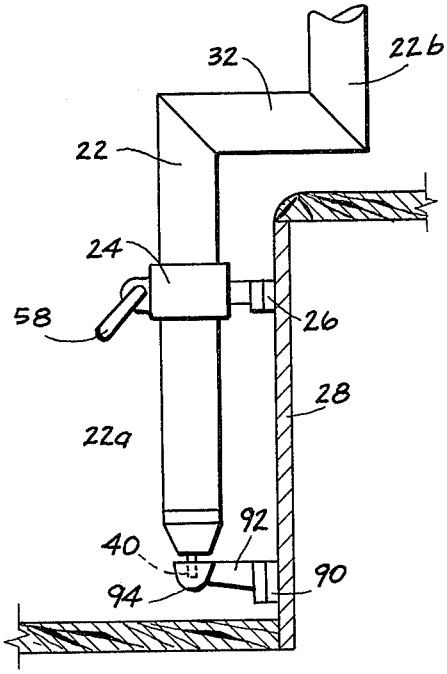
FIG. 7 is a view in side elevation, similar to FIG. 3, illustrating another embodiment of the invention.

FIGS. 1–6 illustrate a particular embodiment of the boat table of the present invention. However, many variations are possible in the described arrangement and use of the disclosed boat table assembly. Thus, FIG. 7 shows a further embodiment of the invention wherein a modified construction of the base support means is employed. Specifically, a second side bracket 90 is provided and includes a bracket extension 92 terminating in socket means 94 which provides a vertically spaced aperture for the pin 40 of the upstanding support. Such construction enables the boat table to be adapted to situations where the segment 22a of the upstanding support is of insufficient length with respect to the bulkhead 28.

Figure 8:
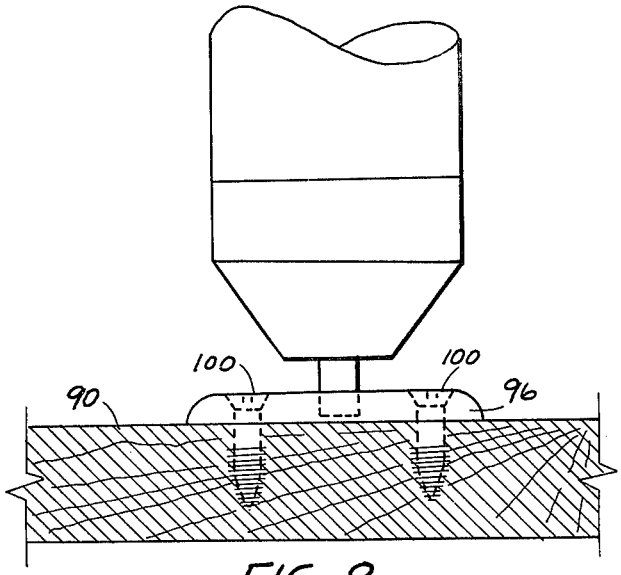
FIG. 8 is an enlarged detailed view illustrating a still further embodiment of the invention.

FIG. 8 illustrates a further modification of the base support means such as might be utilized where it is desired that the base support substantially carry the weight of the boat table, rather than the side bracket 26. As illustrated, the base support is formed as a protective plate 96 which is directly mounted on the deck or footing 98 by suitable attachment means 100. Base support plate 96 can be constructed of hard metal, shock resistant plastic, or other suitable means providing a measure of protection to the decking 90.

Figure 9:
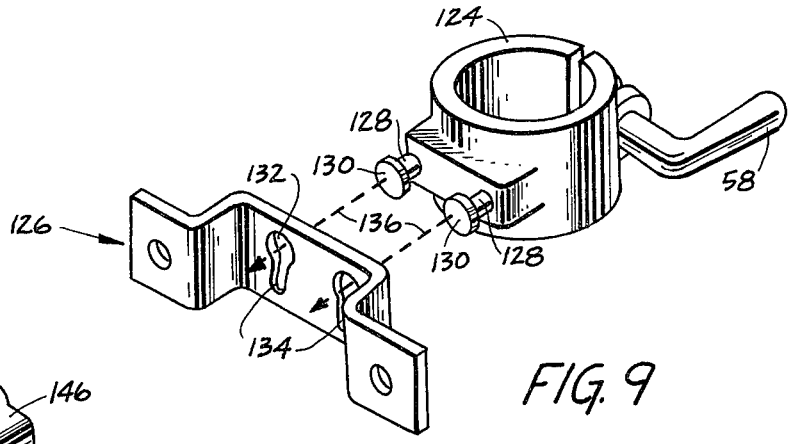
FIG. 9 is a detail view in perspective, illustrating another embodiment of the invention.
Figure 10:
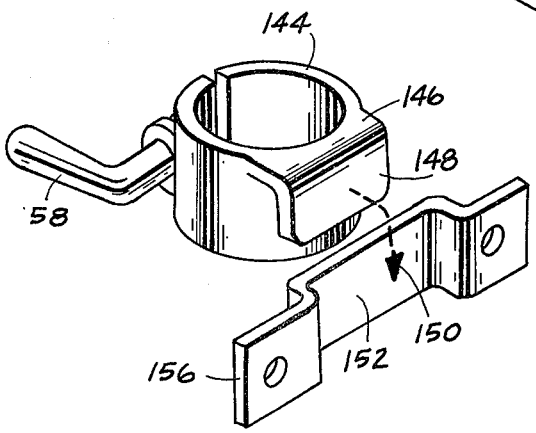
FIG. 10 is a like view illustrating a still further embodiment of the invention.

FIGS. 9 and 10 illustrate further embodiments of the boat table based on modifications of the cooperating mechanisms of the side bracket and clamping means. Thus, FIG. 9 illustrates clamping means 124 provided with table support extensions 128 provided with enlarged heads 130. The latter are received within enlarged openings 132 in keyed slots 134, extending vertically in a modified form of side bracket means 126. As represented by the arrows 136, the enlarged heads 130 of the extensions 128 pass through the openings 132, following which downward movement of the clamping means causes the support extensions 128 to be locked within the slot extensions 134.

In FIG. 10, the clamping means 144 is provided with a simplified lug extension 146 in the form of a downwardly directed flange 148. As represented by the arrow 150, the flange 148 is received in supporting fashion behind an offset portion 152 of a modified side bracket means 156.

Figure 11:
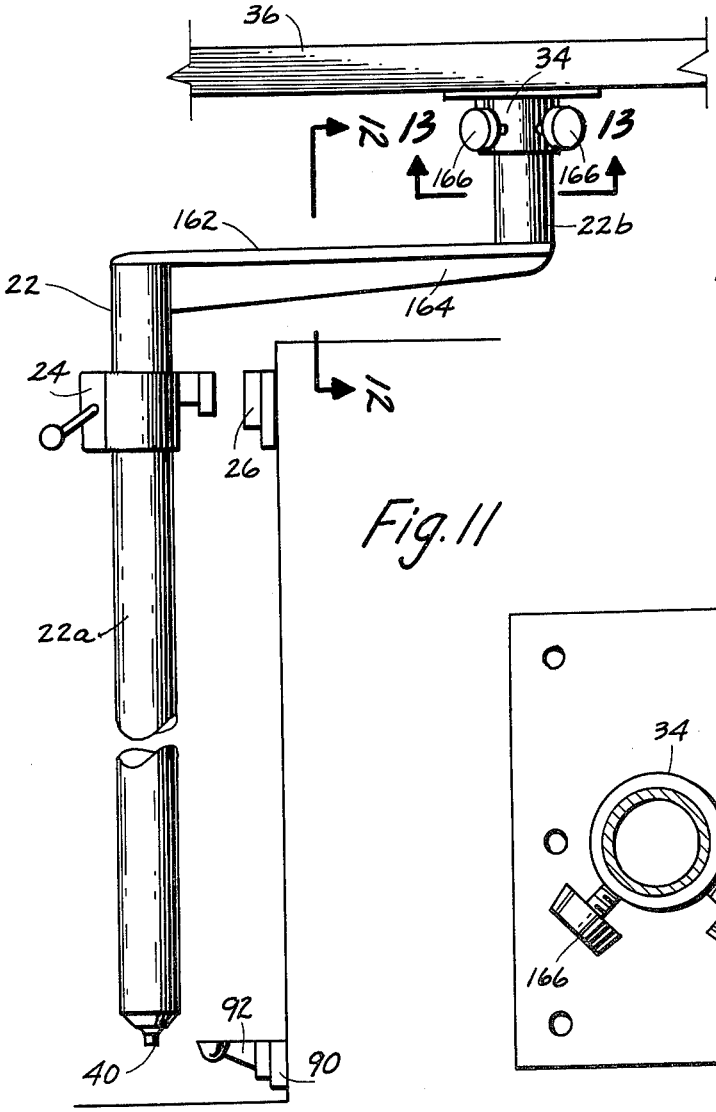
FIG. 11 is a view in side elevation similar to FIG. 3, illustrating a still further embodiment of the invention.
Figure 12:
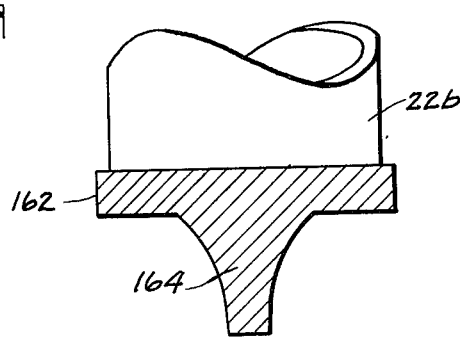
FIG. 12 is an enlarged detail view in section, along the line 12—12 of FIG. 11.
Figure 13:
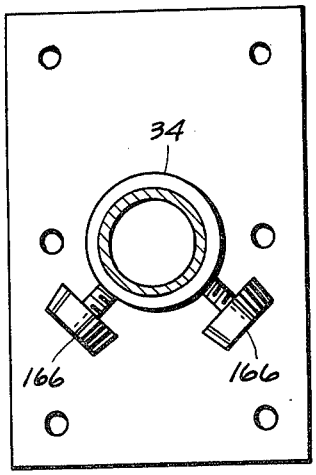
FIG. 13 is a detail view in horizontal section, along the line 13—13 of FIG. 11.

FIGS. 11–13 illustrate a still further embodiment of the invention, similar to FIG. 7, making use of a modified construction of the offset portion of the upstanding support. Specifically, as illustrated, the offset portion 162 has a T-shaped cross section, including a downwardly directed strengthening rib 164. The offset portion 162 can be rigidly attached to the segments 22a and 22b of the upstanding support by strength welding or other suitable procedure. FIGS. 11 and 13 also show a modified locking mechanism for the table mounting means 34 in the form of two threaded members 166. In general, the embodiment of FIGS. 11—13 is useful with somewhat heavier constructions of the table slab 36.

Figure 14:
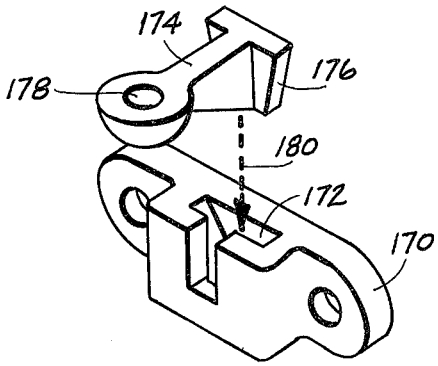
FIG. 14 is a detail view in perspective, illustrating a particular feature of the embodiment of FIG. 11.

FIG. 14 illustrates a still further embodiment wherein the base support means is formed in two parts, including a side bracket 170 having a shaped recess 172 and a removable base support member 174 with a cooperating tapered lug 176. As illustrated, the base support member 174 is provided with a socket aperture 178 to receive the pin 40 of the upstanding support. As represented by the arrow 180, the separate base socket or support 174, 178 is removably positioned within the side bracket 170 by inserting the lug 176 in the recess 172.

Figure 15:
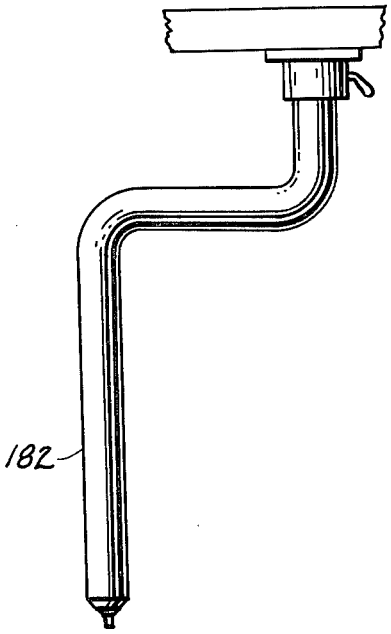
FIG. 15 is a fragmentary view in side elevation, illustrating still another embodiment of the invention.

FIG. 15 illustrates a still further embodiment of the invention wherein the upstanding support is formed as a unitary cylindrical member 182. In this embodiment, the upstanding support can be solid or tubular depending upon the material of construction, and strength requirements. By way of illustration, the upstanding support 182 could be of cast metal or molded plastic construction or, alternatively, of stainless steel tubing. Many other and additional variations will similarly occur to those skilled in the art, and can be employed with the disclosed boat table construction without appreciable change in the overall structure or concept. Accordingly, it should be understood that the disclosures herein are purely illustrative and not in any sense limiting.

What is claimed is:

1. In a boat table, side bracket means for mounting on a support, releasable clamp means insertable in said side bracket means, upstanding support means including substantially parallel upper and lower portions connected by an intermediate offset portion providing a lateral pivot extension for said upper portion, said upstanding support means lower portion being rotatably and vertically slidably engageable within said clamp means, a table carried by said upstanding support means, and base support means receiving a lower end of said upstanding support means, whereby said table can be assembled for swivel mounting within said releasable clamp means upon said base support means, freely pivoted to desired position within said clamp means, and then clamped securely in desired position.

2. A boat table as in claim 1 wherein said side bracket means is provided with a shaped recess and said releasable clamp means is provided with a cooperating shaped lug adapted to be received within the recess of said bracket means.

3. A boat table as in claim 1 wherein said upstanding support means is provided with an outer generally cylindrical surface and said releasable clamp means includes opposed semicylindrical members together with manually operable means to being said opposed members together to thereby fix the position of said upstanding support means.

4. A boat table as in claim 1 wherein said upstanding support means and said offset portion are of a generally cylindrical tubular construction.

5. A boat table as in claim 1 wherein said offset portion of said upstanding support means has a generally T-shaped cross section.

6. A boat table as in claim 1 wherein table mounting means are provided and rotatably engaged on an upper end of said upstanding support means, and locking means are additionally provided for positioning said table and table mounting means in fixed rotary position.

7. A boat table as in claim 1 wherein said base support means comprises separate bracket means, said separate bracket means including socket means receiving the lower end of said upstanding support means.

8. A boat table as in claim 1 wherein said base support means comprises an aperture formed in a footing structure of said boat.

9. In a collapsible, space-saving boat table, bracket means for mounting on a vertical support, releasable clamp means insertable in said bracket means, upstanding generally cylindrical support means engageable within said clamp means, table mounting means rotatably engageable on an upper end of said upstanding support means, a table carried by said table mounting means, locking means for positioning said table mounting means in fixed rotary position on said upstanding support means, said upstanding support means including substantially parallel upper and lower portions connected by an intermediate offset portion providing a lateral pivot extension for said table, said upstanding support means lower portion being rotatably and vertically slidably engageable within said clamp means, and base support means receiving the lower end of said upstanding support means, whereby said table can be mounted within said releasable clamp means and base support means, freely pivoted therein and clamped in desired swivel position by said clamp means and locked securely in desired rotary position by said locking means.

10. A boat table as in claim 9 wherein said table mounting means is provided with a generally cylindrical recess, said cylindrical recess being received on an upper end of said upstanding generally cylindrical support means.

11. A boat table as in claim 10 wherein said downwardly opening recess is formed by a cylindrical extension on said table mounting means, and said locking means comprises a frictionally engageable member threaded through said cylindrical extension.

12. In a swivel mounted, selectively positioned boat table, bracket means for mounting on a vertical support, said bracket means having an upwardly opening downwardly tapering recess, releasable clamp means insertable in said bracket means, said clamp means including protruding lug means having cooperating downwardly tapering sides engageable in the downwardly tapering recess of said bracket means, said clamp means including opposed semicylindrical clamping members, clamp engaging means to move said opposed semicylindrical clamping members towards one another in a clamping operation, upstanding generally cylindrical support means engageable in said opposed clamping members, said upstanding support means including substantially parallel upper and lower portions connected by an intermediate offset portion providing a lateral pivot extension for said upper portion, said upstanding support means lower portion being rotatably and vertically slidably engageable within said clamp means, table mounting means rotatably engageable on an upper end of said upstanding support means, a table carried by said table mounting means, locking means for positioning said table mounting means in fixed rotary position on said upstanding support means, and base support means in the form of a socket receiving the lower end of said upstanding support means, whereby said table can be mounted and pivoted to desired position within said releasable clamp means and said base support means, and thereafter clamped and locked in such desired position of use.

* * * * *